US008348264B2

(12) United States Patent
Krucinski

(10) Patent No.: US 8,348,264 B2
(45) Date of Patent: Jan. 8, 2013

(54) TWO-POINT REGISTRATION DEVICE CONTROL

(75) Inventor: Martin Krucinski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 247 days.

(21) Appl. No.: 12/495,328

(22) Filed: Jun. 30, 2009

(65) Prior Publication Data

US 2010/0327517 A1 Dec. 30, 2010

(51) Int. Cl.
*B65H 7/02* (2006.01)

(52) U.S. Cl. ..... 271/227; 271/228

(58) Field of Classification Search ..... 271/228, 271/227

See application file for complete search history.

(56) References Cited

U.S. PATENT DOCUMENTS 5,269,509 A 12/1993 Cromar et al.
5,609,428 A * 3/1997 Tanaka et al. ..... 400/579
5,678,159 A 10/1997 Williams et al.
5,887,996 A 3/1999 Castelli et al.
6,059,284 A 5/2000 Wolf et al.
2001/0006273 A1* 7/2001 Butterfass et al. ..... 271/227
2006/0163801 A1* 7/2006 Dejong et al. ..... 271/227
2008/0136092 A1* 6/2008 Elliot ..... 271/228
2008/0237975 A1* 10/2008 de Jong et al. ..... 271/228
2008/0237979 A1* 10/2008 Tamura et al. ..... 271/270
2009/0057994 A1* 3/2009 Kondo ..... 271/228
2009/0066016 A1* 3/2009 Kato et al. ..... 271/227
2009/0121419 A1* 5/2009 deJong et al. ..... 271/228
2009/0134570 A1* 5/2009 Hayakawa ..... 271/227
2010/0013149 A1* 1/2010 Kondo ..... 271/228

OTHER PUBLICATIONS

R. Sanchez et al., "Paper Sheet Control Using Steerable Nips," Proceedings of the 2004 American Control Conference, pp. 482-487.

* cited by examiner

*Primary Examiner* — Prasad Gokhale

(57) ABSTRACT

A control system and method for a sheet registration device including a general unit which determines desired contact point velocities for moving a sheet along a reference trajectory. The contact point velocity determination is independent of the sheet registration device. A specific unit is operably connected to the general unit. The specific unit determines registration device specific operating parameters for controlling registration device actuators to move the sheet along the reference trajectory.

20 Claims, 6 Drawing Sheets

TWO-POINT REGISTRATION DEVICE CONTROL

TECHNICAL FIELD

The presently disclosed embodiments are directed to sheet registration within a document processing machine such as a printer.

BACKGROUND

Various document processing machines such as printing machines need to align a sheet with its corresponding image prior to transferring the image to the sheet. Proper alignment is needed in order to accurately transfer the image to the correct location on the sheet. Many elements of a machine such as a platen, belt, or image transfer element are static or have fixed motions and therefore not amenable to realignment. The sheet, however, is dynamic. Therefore, many printing machines contain a registration device that realigns the sheet in order to facilitate accurate placement of the image transfer onto the sheet.

As a sheet moves through a printer, there is a desired path over which the sheet travels in order to remain in proper alignment for printing. Typically, the trajectory of the traveling sheet tends to diverge from the desired path. This divergence can be caused by many factors such as a sheet being fed incorrectly into a printer, or a sheet being at an angle on the feed tray, etc. The divergence is corrected by way of the registration device.

Several types of registration devices exist which utilize different means of realigning a sheet. For example, certain registration devices are mechanistic using a combination of direct current and stepper motors to drive the sheet. Others use a split nip shaft where each drive roller is driven by a separate motor. Another device uses nips as well as a cross-process motor, which alters movement along the y-axis of a sheet.

To correct this divergence, most registration devices contact the sheet at two points or "nips" and have 3 or more degrees of freedom. The degrees of freedom of the sheet in the plane of sheet travel include: process direction, cross-process direction, and angular velocity. In order to have accurate sheet registration, all three degrees of freedom must be identified and accurately adjusted. The velocity vectors at the two contact points of registration devices with four or more degrees of freedom induce an additional factor, buckling or stretching of the sheet between the two contact points. If the velocity vectors at the two contact points are not controlled correctly, the sheet may buckle or stretch in a cross-process direction between the contact points of the registration device. Buckling or stretching can lead to sheet jams and/or sheet damage. Hence, for registration devices with 4 or more degrees of freedom, it is important that the buckling/stretching between the two contact points is properly controlled.

Typically, a registration controller locates the sheet with respect to the position of the image. For example, the sheet may be sensed and signals sent to a registration device to cause the sheet to position accurately in relation to the image. A single controller typically receives sensor information and alters the velocity of nips accordingly.

Registration devices come in varying configurations and may each require their own specific control algorithm to properly operate. The printing machine having a registration device includes controls for tracking the sheet, calculating the sheet's present trajectory, and providing signals to the registration device to correct deviations from the theoretical path.

Such information is operated on by an algorithm specific for the registration device. The controls for the registration device and for tracking the sheet and determining its trajectory are typically intertwined with the algorithm controlling the registration device. If the registration device is replaced with a different type of registration device, perhaps for maintenance or upgrading purposes, the entire control mechanism and software need to be modified to accommodate the new device. Depending on the machine, such modification may not be possible and the choice of registration devices would be limited.

SUMMARY

According to aspects illustrated herein, there is provided a method for registering a sheet within a printing machine having a registration device having sheet contact points including:

- determining a desired sheet reference trajectory;
- sensing an actual sheet position;
- comparing the sheet position to a desired sheet reference trajectory;
- responsive to the comparison, calculating a desired sheet reference point velocity necessary to alter the sheet position to track the reference trajectory, the calculation being independent of the registration device;
- responsive to the calculated desired sheet reference point velocity,
- calculating desired contact point velocities;
- converting the desired contact point velocities to registration device specific actuator positions and velocities; and
- controlling registration device actuators to achieve the desired contact point velocities.

According to additional aspects illustrated herein, there is provided a control system for a sheet registration device including a general unit for determining desired contact point velocities for moving a sheet along a reference trajectory. The contact point velocity determination is independent of the sheet registration device. A specific unit is operably connected to the general unit. The specific unit determines registration device-specific operating parameters for controlling registration device actuators to move the sheet along the reference trajectory.

According to further aspects illustrated herein, there is provided a system for registering a sheet prior to processing including a registration device having a plurality of sheet contact points and a plurality of actuators for controlling the trajectory of a sheet. At least one sheet sensor identifies information related to an actual sheet position. A sheet reference position generator determines a reference sheet trajectory. A sheet module is operably connected to the sheet reference position generator. The sheet module compares actual sheet position to the reference trajectory and determines a desired sheet reference point velocity for adjusting the sheet trajectory to track the reference trajectory. A general registration module is in operative communication with the sheet module. The general registration module determines desired contact point velocities responsive to the desired sheet reference point velocity. The desired contact point velocities are determined independent of the registration device.

DETAILED DESCRIPTION

Figure 1:
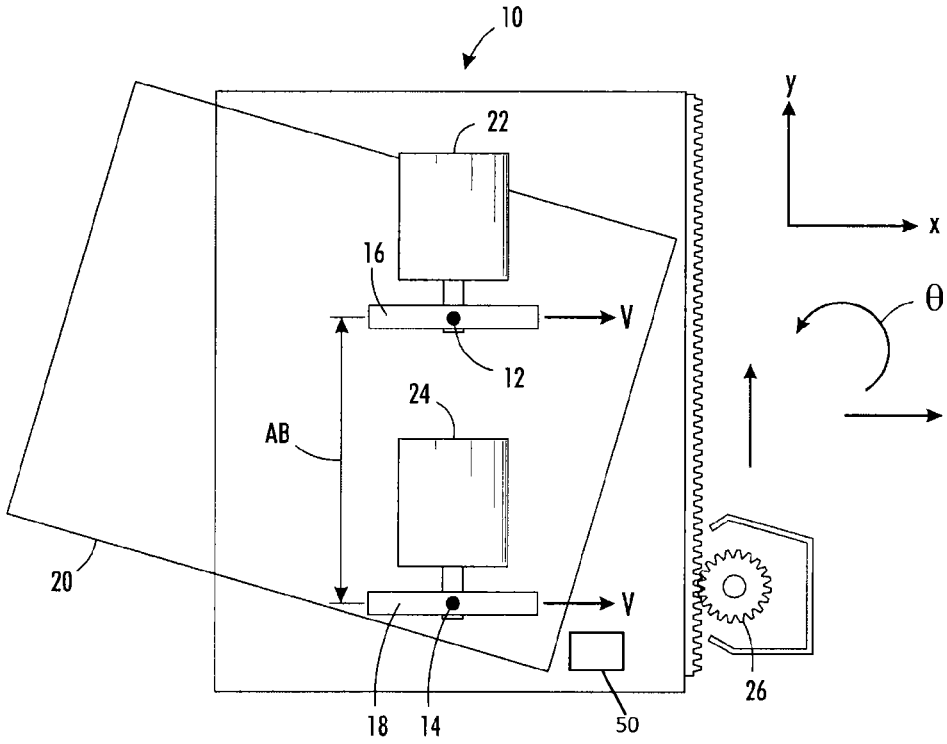
FIG. 1 is a plan view of a registration device operating on a sheet.

Exemplary embodiments of the systems and methods are described herein with reference to the Figures. According to these embodiments, a method and system of controlling a sheet as it moves through a printing machine is disclosed. Specifically, the determination of control parameters relating to the sheet moving through a printing machine is separated from the determination of the control parameters of the registration device.

By separating control of such parameters as sheet trajectory from control of the registration device contact points, the same sheet control can be utilized with any type of registration device. This provides a great degree of flexibility to the design architecture of printing machines. It also enhances specific control of the sheet irrespective of the factors affecting the actual registration device employed.

These methods and systems are disclosed and designed for use with registration devices that contact a sheet in at least two locations and have three or more degrees of freedom.

In accordance with these methods and systems, the trajectory of a sheet, on which an image is to be imparted, is monitored and controlled. A sensor identifies the sheet position. The sheet position is then compared to a reference trajectory, i.e., the path that the sheet needs to travel in order for the image to be correctly transferred to the sheet. By comparing the sheet position to the reference trajectory, the sheet velocities necessary for it to track the reference trajectory, can be calculated. The necessary sheet velocities are used to calculate the desired contact point velocities needed to achieve this tracking. The desired contact point velocities are used to calculate the desired registration device velocities for the specific registration device in use. The information gathering and desired sheet velocity determination is generic, i.e., it is not specific to a single registration device. The same information gathering and conversion portion can be utilized with any registration device.

As used herein, the term "printing machines" refers to any apparatus, such as a digital copier, bookmaking machine, facsimile machine, multi-function machine, etc., which performs a print outputting function for any purpose and which transfers an image to a sheet. The "printing machine" must utilize some form of registration device.

As used herein, the term "registration device" refers to an element of a printing machine the function of which is to correct displacement and/or rotation errors of a sheet.

As used herein, the term "sheet" refers to any form of media capable of having an image transferred thereto by a printing machine.

As used herein, the term "sheet reference trajectory" refers to a theoretical reference x, y, and angular positions of a sheet over time as it moves through a printing machine.

As used herein, the term "contact point" refers to a location where the registration device meets the sheet such as, for example, nips.

As used herein, the term "module" refers to a computational device or sequence for calculating data based on input and generating an output.

As used herein, the term "actuator" refers to a motor or other device for imparting movement.

As used herein, the term "image transfer" refers to the deposition of markings, colored or black, onto a sheet.

As used herein, the term "sheet trajectory" refers to the x, y, and angular positions of a sheet over time as it moves through a printing machine.

As used herein, the term "sheet position" refers to the x, y and angular positions of a sheet within a printing machine at a given time.

As used herein, the term "sheet reference point velocity" refers to the velocity of a point associated with a sheet and the associated sheet angular velocity.

As used herein, the term "sheet sensor" refers to a device which senses the presence, position, and/or velocity of a sheet.

As used herein, the term "sheet reference trajectory generator" refers to a device including either hardware or software which determines a desired reference trajectory for a sheet entering a printing machine.

As used herein, the term "sheet module" refers to a device including either hardware or software which determines sheet parameters such as desired sheet velocities.

As used herein, the term "general registration module" refers to a device including either hardware or software which determines registration device parameters, such as contact point velocities. The parameters may be aspecific to any particular registration device.

FIG. 1 is an illustration of an exemplary registration device 10 that can be used in a printing machine. Registration device 10 has two contact points A, 12, and B, 14, and three degrees of freedom. The contact points 12, 14, may include rollers 16 and 18 that engage the sheet 20 and control its movement. The rollers 16 and 18 are driven by actuators 22 and 24, respectively. Actuator 26 alters the sheet position and moves both contact points in the cross-process (y) direction. All three actuators work to correct the $v_x$, $v_y$ and $\omega$ velocities of a sheet 20.

Figure 2:
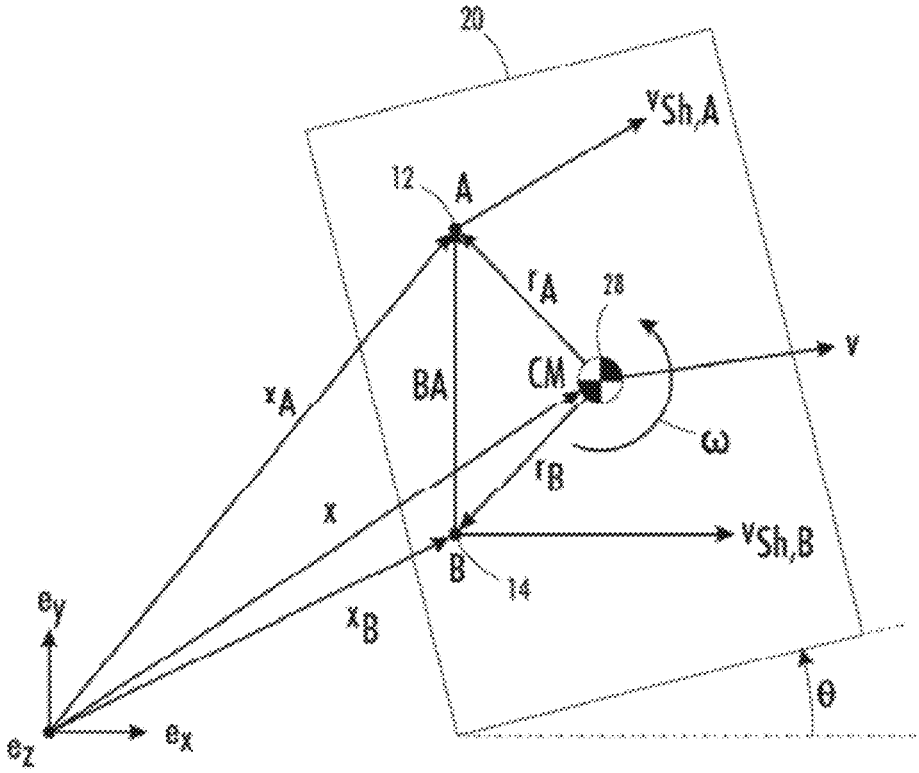
FIG. 2 illustrates an overview of a two contact point registration device driving a sheet showing various vectors and trajectory.

With additional reference to FIG. 2, an overview of a sheet 20 having a center of mass, CM, 28 being driven by a resignation device is shown. The contact points A and B, 12, 14, respectively, are configured to rotate at a specific velocity in an x-direction and are also each configured to operate under the control of one or more actuators 22, and 24. The contact points 12, 14 are configured to contact the sheet 20 as it moves through the registration device 10. The actuators 22, 24 are configured to receive instructions from a specific module discussed below. The actuators 22, 24, are further configured to provide power and movement to the contact points 12, 14. The actuators 22, 24 are configured to provide power to contact points 12, 14 respectively for movement in the process direction (x). Activation of an actuator 26 results in the contact points 12 and 14 moving in a vertical or (y) direction. Errors in angular velocity may occur when actuators 22, 24, 26 provide power at different rates resulting in different velocities at contact points 12, 14. By controlling actuators 22, 24 and 26 at different rates, the trajectory of the sheet can be adjusted.

During sheet transportation in a machine such as a printing machine, the position of the sheet typically deviates from the intended path or reference trajectory. The registration device is used to correct the sheet trajectory. In operation, as with reference to FIGS. 1 and 2, sheet 20 enters registration device 10 at a specific angle θ and x and y position. The registration device 10 is configured to return the sheet 20 to the reference trajectory. The registration device 10 has two contact points A 12 and B 14, one or more actuators 22, 24, 26, which provide power to each contact point 12, 14. The actuators 22, 24, 26 adjust the angle θ and vertical movement x of the contact points A, B to affect the position of the sheet 20. Reaction forces are generated by the sheet 20 contacting the contact points 12, 14 and moving through the registration device 10; these forces may affect the speed of the actuators 22, 24, 26. The operating parameters of the actuators such as rotational velocity and duration of actuation may be varied in order to maintain the velocities and positions necessary for the actual contact point velocities to track the desired contact point velocities, thereby aligning the sheet 20 with the reference trajectory.

Figure 3:
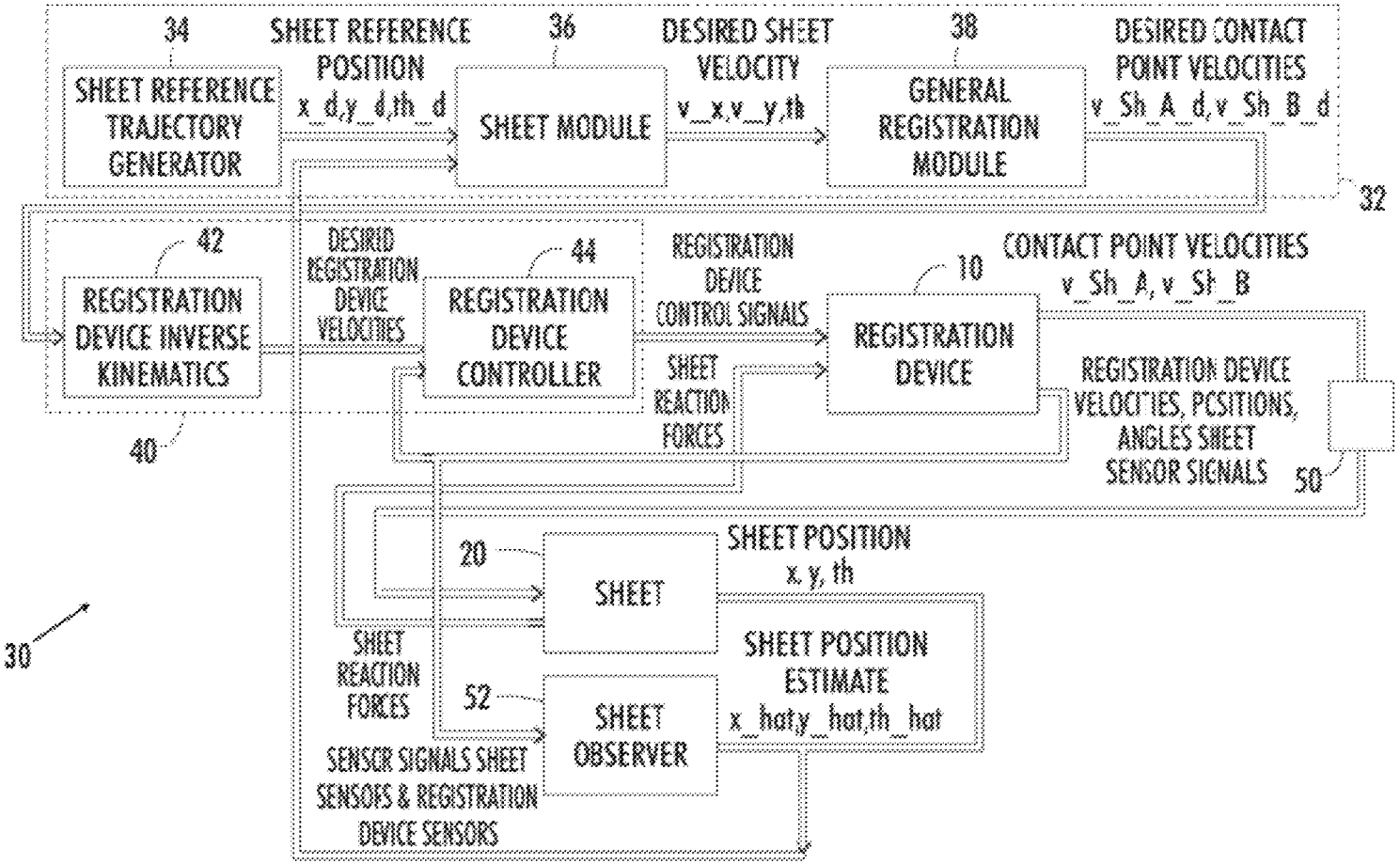
FIG. 3 is a schematic view of a registration control architecture.

FIG. 3 illustrates an overview of the registration control system 30 that may be used to control the registration device 10. The registration control system 30 is divided into two main units, a general unit 32, and a specific unit 40. The general unit 32 is aspecific and its adjustment is performed without consideration for the particular registration device employed in a certain printing machine. The general unit 32 determines the desired sheet velocity needed to track the reference trajectory and determines desired velocities of the sheet contact points to achieve the determined sheet velocities. Factors affecting the general unit 32 calculations include, for example, distance between the contact points, sheet sensor location, the distance from and the contact points to the image transfer zone. The parameters for these factors can be easily adjusted. The general unit 32 may include a sheet reference trajectory generator 34, a sheet module 36, a general registration module 38, and a sheet observer 52. The components of the general unit 32 may include hardware and software elements and may be separate modules or components or may be integrated together such as part of a microprocessor.

The sheet reference trajectory generator 34 determines the desired sheet reference trajectory x, y, θ. The sheet position includes x-process direction (x), y-cross-process direction (y) and angular θ positions of the sheet 20. The desired trajectory is that which will result in the sheet being in the proper position for processing such as image transfer.

The control system 30 may include a plurality of sensors 50 which may be part of the registration device 10 that sense a sheet 20 as it travels though the printing machine. These sensors 50 generate signals which are received by the sheet observer 52. Sheet observer 52 receives signals from the registration device sensors 50 and other sensors throughout the path of sheet 20 between entry into the printing machine and image transfer. Based on the sensor signals, the sheet observer 52 calculates the estimated actual position and trajectory of the sheet 20. The sheet observer 52 may be part of the general unit 32.

Sheet module 36 is in operative communication with the sheet reference trajectory generator 34. The sheet module 36, in addition to receiving the desired sheet reference trajectory, receives an estimate of the actual sheet position from the sheet observer 52. The sheet module 36 compares the actual sheet position to the reference position. The reference position is a specific position value at a specific time based on the reference trajectory, and it includes both x, y, and angular position. Typically a deviation occurs between the actual sheet position and the reference position. Accordingly, correction of the sheet trajectory is necessary. Based on this comparison, the sheet module calculates a desired sheet reference point velocity necessary to alter the sheet position to track the reference trajectory. This calculation is independent of the registration device. The reference point may be any point on the sheet or even a point outside of the sheet, but considered attached to the sheet. The desired sheet reference point may be the sheet center of mass. For example, if the point is the sheet's center of mass, then the velocity of the sheet's center of mass which would cause the sheet to follow the reference trajectory would be calculated Sheet module 36 is a generic module in that it is not specific to any particular registration device. Accordingly, if a new registration device is needed it can be added to the machine without the need to reconfigure or reprogram the sheet module.

The sheet module 36 is operably connected to a general registration module 38. The general registration module 38 calculates the desired velocities of the contact points A and B, based on the desired sheet reference point velocity calculated by the sheet module. The general registration module 38 is a generic module in that it is not specific to any particular registration device, but does need the location of the two contact points.

The two-point registration control system 30 further includes a specific unit 40. The specific unit 40 includes an inverse kinematics module 42; and a registration device controller 44. The inverse kinematics module 42 is configured to receive information from the general registration module 38 and is further configured to calculate the desired velocities and positions of the registration device actuators 22, 24, 26 (FIG. 1) required to achieve the desired velocities of the contact points 12, 14 communicated from the general registration module 38. Therefore, the inverse kinematic module 42 would calculate the operating parameters for the actuators such as how fast and for how long to spin the motors driving the actuators. These velocities vary depending on the particular registration device in use. Accordingly, the inverse kinematics module 42 is registration device specific. The inverse kinematics module 42 may include hardware and software elements and/or part of a microprocessor.

The registration device controller 44 is operably connected to the inverse kinematic module 42 and the registration device actuators 22, 24, and 26. The controller 44 receives the desired actuator operating parameters, such as velocities and time of operation, from the inverse kinematic module 42 and generates signals to drive the actuators 22, 24, and 26 in accordance with the determined operating parameters to ensure that the actual contact point velocities substantially track the desired contact point velocities.

Registration device controller 44 and inverse kinematics module 42 are specific to the particular registration device 10. Therefore, if the registration device 10 of a printing machine is changed, the registration device controller 44 and inverse kinematics module 42 would also be reprogrammed, reconfigured, replaced or modified.

Figure 4:
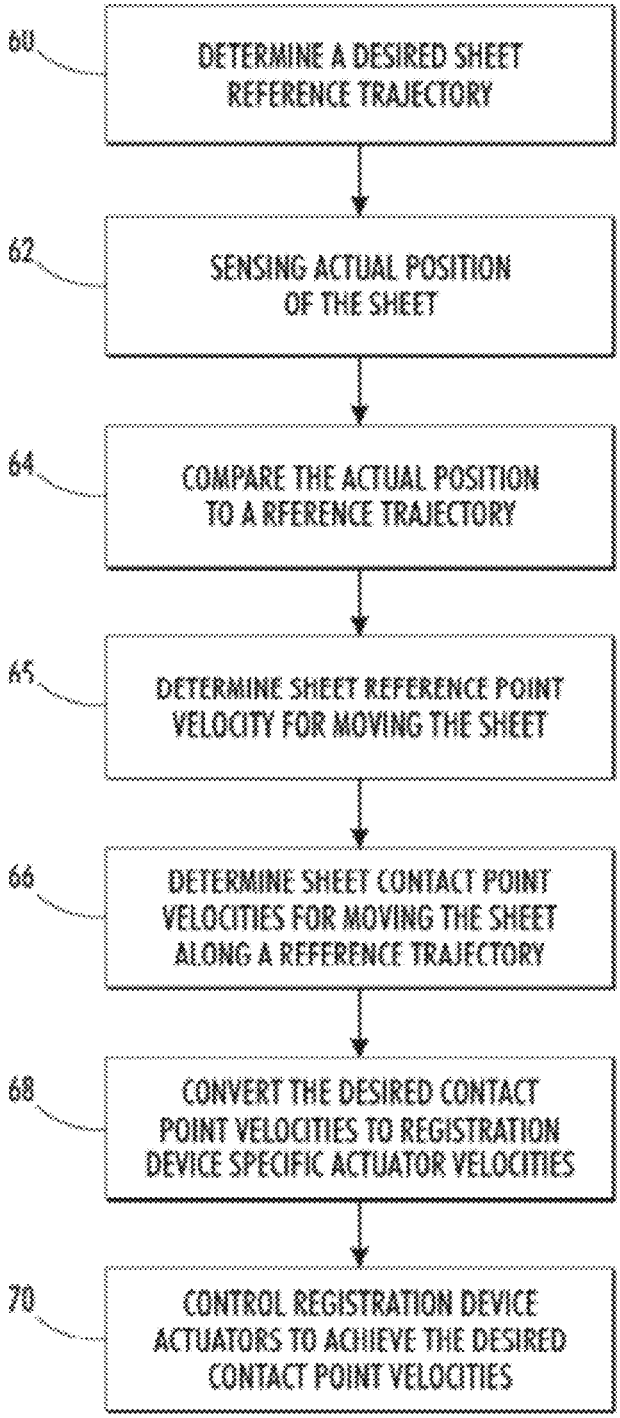
FIG. 4 is a flow chart of a method for controlling a sheet with a registration device.

With reference to FIG. 4, the registration control system may perform a method of registering a sheet within a printing machine. A desired sheet reference trajectory is determined 60. An actual position of the sheet may be sensed 62. The actual position of the sheet is compared to the reference trajectory 64. Responsive to this comparison, the sheet reference point velocity needed to move the sheet along the reference trajectory is determined 65. This calculation is independent of the registration device. In response to the sheet reference point velocity calculation, sheet contact point velocities are determined for moving the sheet along a reference trajectory 66. The desired contact point velocities may be converted to registration device specific actuator velocities 68. The registration device actuators may be controlled to achieve the desired contact point velocities 70.

In the sheet module 38, each degree of freedom is independently controlled from each other which simplifies the controller design and allows the degrees of freedom, x, y, θ to be independently adjusted or tuned to obtain the desired response.

The mathematical algorithms conducted by the sheet module 36 and general registration module 38 will now be described with reference to the parameters shown in FIG. 2. FIG. 2 illustrates the velocities and positions of a sheet in a registration device. The basis vectors are $e_x$ (in the process direction of sheet travel), $e_y$ (in the cross-process direction) and $e_z$ where $e_z$ is a vector perpendicular to the plane of the sheet. Certain positions are defined with reference to contact points A, 12 and B, 14. Specifically, $x_A$ and $x_B$ represent the absolute positions of contact points A and B, in relation to the unit vectors (discussed below). The velocity of the sheet at the contact point is $v_{10,A}$ and $v_{10,B}$. The position of the contact point is defined with reference to the sheet center of mass 28 as $r_A$ and $r_B$. The sheet position at the center of mass, CM, 28 is defined by x (the linear position of the sheet), and Θ (the angular position of the sheet relative to the reference vector $e_z$, i.e., the angular position of the sheet in the plane of the sheet). The sheet velocity at the center of mass, CM, 28 is the linear velocity v and angular velocity ω.

General registration module 38 converts the desired sheet velocities as set by the sheet module 36 to the desired velocities of the sheet at the two contact points A and B. Velocity (v) of sheet 20 at the two contact points A and B are calculated based on the velocity (v) and angular velocity (ω) of the sheet at its center of mass 28. As stated above, contact points A and B each have a position (r) relative to the sheet center of mass. The velocity of the two contact points is related to the velocity of the sheet at its center of mass as follows:

$$v_{Sh,A}=v+\omega\times r_A \tag{1}$$

$$v_{Sh,B}=v+\omega\times r_B \tag{2}$$

To calculate the relationship between the sheet velocities at contact points A and B, vSh,A and vSh,B, and the angular velocity ω, subtract the two contact point velocities:

$$\begin{aligned} v_{Sh,A}-v_{Sh,B} &= \omega\times(r_A-r_B)=\omega\times[(x_A-x)-(x_B-x)] \\ &= \omega\times(x_A-x_B)=\omega\times BA \end{aligned} \tag{3}$$

The above equations can be written as follows:

$$\begin{bmatrix} v_{Sh,A,x}-v_{Sh,B,x} \\ v_{Sh,A,y}-v_{Sh,B,y} \\ 0 \end{bmatrix} = \begin{bmatrix} 0 \\ 0 \\ \omega \end{bmatrix} \times \begin{bmatrix} BA_x \\ BA_y \\ 0 \end{bmatrix} = \begin{bmatrix} -\omega BA_y \\ \omega BA_x \\ 0 \end{bmatrix} \tag{4}$$

Depending on the location of the contact points A & B, the sheet angular velocity can be calculated using one of the following formulae, selecting the one that avoids dividing by zero:

$$\omega = \begin{cases} \dfrac{v_{Sh,A,y}-v_{Sh,B,y}}{BA_x} & \text{if } BA_x \neq 0 \\ \dfrac{v_{Sh,A,x}-v_{Sh,B,x}}{BA_y} & \text{if } BA_y \neq 0 \end{cases} \tag{5}$$

The above step concludes the derivation of the relationship between the contact point velocities and the sheet angular velocity.

To determine the relationship between the sheet velocities at contact points A and B, $v_{Sh,A}$ and $v_{Sh,B}$, and the sheet velocity v, add the two contact point velocities:

$$vSh,A+vSh,B=v+\omega\times rA+v+\omega\times rB=2v+\omega\times(rA+rB) \tag{6}$$

This can now be solved for the sheet velocity v:

$$v=\tfrac{1}{2}[vSh,A+vSh,B-\omega\times(rA+rB)] \tag{7}$$

In order to take the proposed control approach, the inverse of the sheet kinematics map (the map from contact point velocities $v_{Sh,A}$ and $v_{Sh,B}$ to sheet velocities v and ω) from the combined desired sheet velocities $[vx\ vy\ \omega]^T$ to the desired contact point velocities $[vSh,A,x\ vSh,A,y\ vSh,B,x\ vSh,B,y]^T$ is to be determined.

One approach is to utilize the rigid body dynamics equations (1) and (2). If the registration device is successful in applying those desired contact point velocities $v_{Sh,A,d}$ and $v_{Sh,B,d}$ to the sheet, they will result in the desired v and ω sheet velocities, with no buckling/stretching of the sheet.

However, due to various disturbances in the system, the actual contact point velocities of the registration device will be different from the desired. By keeping track of the buckle in this case and modifying the no buckling/stretching constraint, one can design a control law that can control buckle. One choice may be to keep the buckle at 0 mm, another to keep it a 1 mm (sheet slightly buckled throughout registration), a third to keep it at −1 mm (sheet slightly stretched throughout registration), a fourth would be to keep the buckling velocity at −1 mm/s (sheet is slightly stretched continuously throughout registration) in order to avoid any sheet buckle to build up despite disturbances.

To introduce the ability to inject any arbitrary buckling velocity into the control algorithm, the no buckling/stretching constraint is modified slightly and the map from sheet velocities to contact point velocities is re-derived using linear matrix equations that incorporate the buckling control input.

Introduce the following definition for the sum of the relative position of points A and B:

$$D=rA+rB=Dxex+Dyey \tag{8}$$

The matrix representation of this map can now be derived from equation (7) as follows:

$$v_x=v^*\cdot e_x=\tfrac{1}{2}[v_{Sh,A}+v_{Sh,B}-\omega\times(r_A+r_B)]\cdot e_x=\tfrac{1}{2}[v_{Sh,A,x}+v_{Sh,B,x}-\omega D\ e_x] \tag{9}$$

$$v_y=v^*e_y=\tfrac{1}{2}[v_{Sh,A}+v_{Sh,B}-\omega\times D]e_y=\tfrac{1}{2}[v_{Sh,A,y}+v_{Sh,B,y}-\omega\times D\ e_y] \tag{10}$$

Evaluating ω×D yields:

$$\begin{aligned} \omega\times D &= \omega ez\times Dxex+\omega ez\times Dyey \\ &= \omega Dx(ez\times ex)+\omega Dy(ez\times ey)=\omega Dxey+\omega Dy(-ex) \\ &= -\omega Dyex+\omega Dxey \end{aligned} \tag{11}$$

On component form, $v_x$ and $v_y$ can now be expressed as:

$$\begin{aligned} vx &= 1/2vSh,\ A,\ x+1/2vSh,\ B,\ x- \\ &\quad 1/2[-\omega Dyex+\omega Dxey]ex= \\ &= 1/2vSh,\ A,\ x+1/2vSh,\ B,\ y+1/2\omega Dy \end{aligned} \tag{12}$$

-continued $$vy = 1/2vSh, A, y + 1/2vSh, B, y - 1/2[-\omega Dyex + \omega Dxey]ey = = 1/2vSh, A, y + 1/2vSh, B, y - 1/2\omega Dx \quad (13)$$

Re-arranging the above in preparation for matrix form equations yields:

$$v_x - \frac{1}{2}D_y\omega = \frac{1}{2}v_{Sh,A,x} + \frac{1}{2}v_{Sh,B,y} \quad (14)$$

$$v_y + \frac{1}{2}D_x\omega = \frac{1}{2}v_{Sh,A,y} + \frac{1}{2}v_{Sh,B,y} \quad (15)$$

The no buckling/stretching of the sheet constraint can be expressed as:

$$v_{Sh,A}\cdot BA = v_{Sh,B}\cdot BA \Longleftrightarrow (v_{Sh,A} - v_{Sh,B})\cdot BA = 0 \quad (16)$$

To introduce the buckling velocity control input, modify the above constraint to include the buckling velocity in the direction of BA, $\dot{\delta}$ :

$$(vSh,A - vSh,B)\cdot BA = \dot{\delta} \quad (17)$$

Using the definition of BA:

$$BA = BAxex + BAyey \quad (18)$$

the constraint can be re-written as $$[BAx\ BAy - BAx - BAy]\cdot[vSh,A,x\ vSh,A,y\ vSh,B,x\ vSh,B,y] = \dot{\delta} \quad (19)$$

The above equations (5), (14), (15) and (19) can now be written on matrix form:

$$\begin{bmatrix} 1 & 0 & -D_y/2 & 0 \\ 0 & 1 & +D_y/2 & 0 \\ 0 & 0 & 1 & 0 \\ 0 & 0 & 0 & 1 \end{bmatrix} \begin{bmatrix} v_x \\ v_y \\ \omega \\ \delta \end{bmatrix} == \begin{bmatrix} \frac{1}{2} & 0 & \frac{1}{2} & 0 \\ 0 & \frac{1}{2} & 0 & \frac{1}{2} \\ -\frac{1}{BA_y} & 0 & +\frac{1}{BA_y} & 0 \\ BA_x & BA_y & -BA_x & -BA_y \end{bmatrix} \begin{bmatrix} v_{Sh,A,x} \\ v_{Sh,A,y} \\ v_{Sh,B,x} \\ v_{Sh,B,y} \end{bmatrix} \quad (20)$$

By introducing the following nomenclature:

$$Q = \begin{bmatrix} 1 & 0 & -D_y/2 & 0 \\ 0 & 1 & +D_y/2 & 0 \\ 0 & 0 & 1 & 0 \\ 0 & 0 & 0 & 1 \end{bmatrix} \quad (21)$$

and

-continued $$P = \begin{bmatrix} \frac{1}{2} & 0 & \frac{1}{2} & 0 \\ 0 & \frac{1}{2} & 0 & \frac{1}{2} \\ -\frac{1}{BA_y} & 0 & +\frac{1}{BA_y} & 0 \\ BA_x & BA_y & -BA_x & -BA_y \end{bmatrix} \quad (22)$$

The matrix equation (20) can now be written as $$\begin{bmatrix} v_{Sh,A,x} \\ v_{Sh,A,y} \\ v_{Sh,B,x} \\ v_{Sh,B,y} \end{bmatrix} = P^{-1}Q \begin{bmatrix} v_x \\ v_y \\ \omega \\ \dot{\delta} \end{bmatrix} \quad (23)$$

It is now a map from sheet velocities to registration device contact point velocities that includes the sheet buckling velocity control input and is the main content of the general registration module 38.

In order to close the loop, the sheet module 36 is utilized to receive the desired sheet reference trajectory from the sheet reference trajectory generator 34 and the current sheet position from the sheet observer 52 and outputs the required sheet velocities that will drive the sheet to track its reference trajectory. Using the above matrices, each degree of freedom of the sheet, x-velocity, y-velocity and angular velocity, is decoupled, i.e., independent from the other degrees of freedom. The sheet module can function as three separate single-input-single-output (SISO) controllers simplifying both design and tuning of the module. Sheet module 36 can be fine-tuned independent of the specific unit 40, registration device 10, and the sheet observer 52. By independently controlling and tuning the 3 degrees of freedom of the sheet, the tracking performance in each direction can be more easily achieved.

The calculations relating to the sheet position and the desired velocities are preformed by the general unit. These calculations are independent of the registration device used in the printing machine. The algorithms and calculations performed, therefore, may remain the same even when a new registration device is used. The inverse kinematics module may receive the data from the general unit and determine the actual specific velocities of the specific registration device actuators.

The methods and systems described are demonstrated in the following example. The following example illustrates the selection of a registration device as described above and is not intended to limit the above described systems and methods or their scope in any manner.

EXAMPLE

Figure 5:
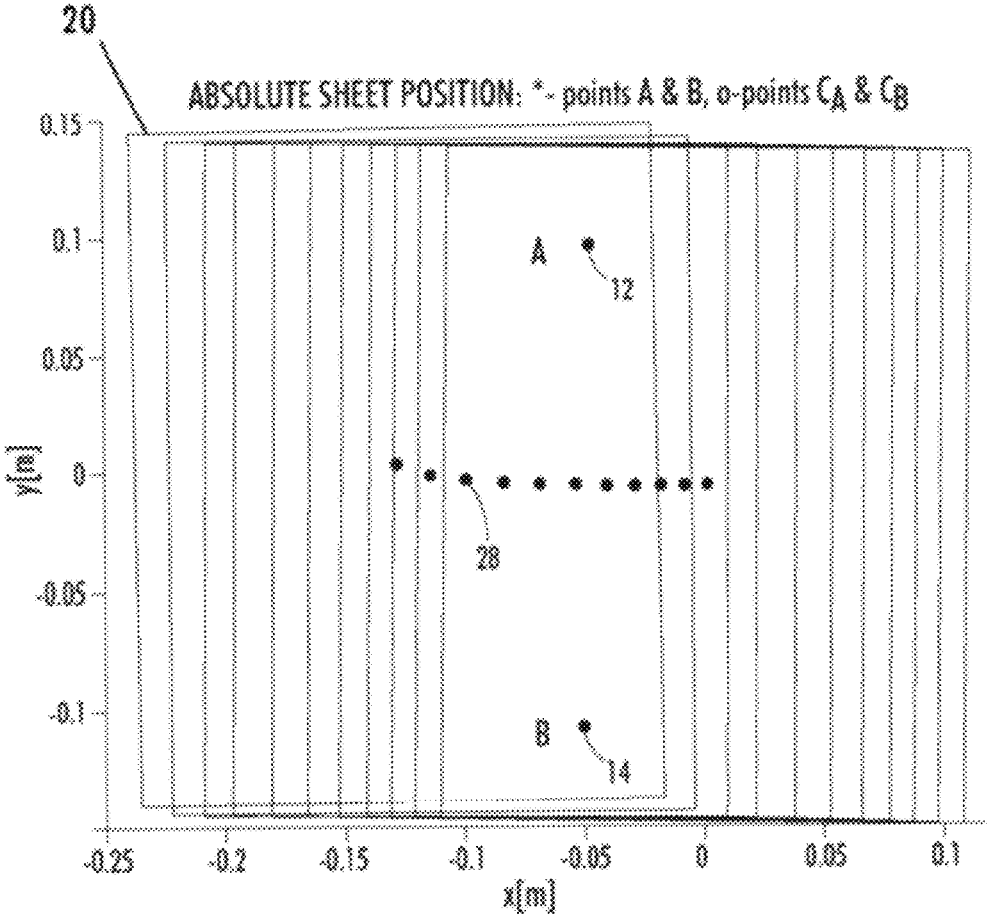
FIG. 5 shows the absolute sheet position as it proceeds through a registration device.

In this example, a sheet enters the registration device with the following position errors: process direction error, 30 mm late, cross-process direction, 8 mm up and with a skew of 25 mrad. The reference position trajectory is a ramp in the x-direction and y and θ equal to 0. The sheet position during registration is shown in FIG. 5. The sheet's center of mass CM 28 and the location of the two contact points A and B are shown. FIG. 5 illustrates the relative sheet position of a sheet relative to its reference trajectory as it moves through a registration device. The position of the sheet 20 is adjusted as it progresses through the registration device through the operation of the contact points.

Figure 6:
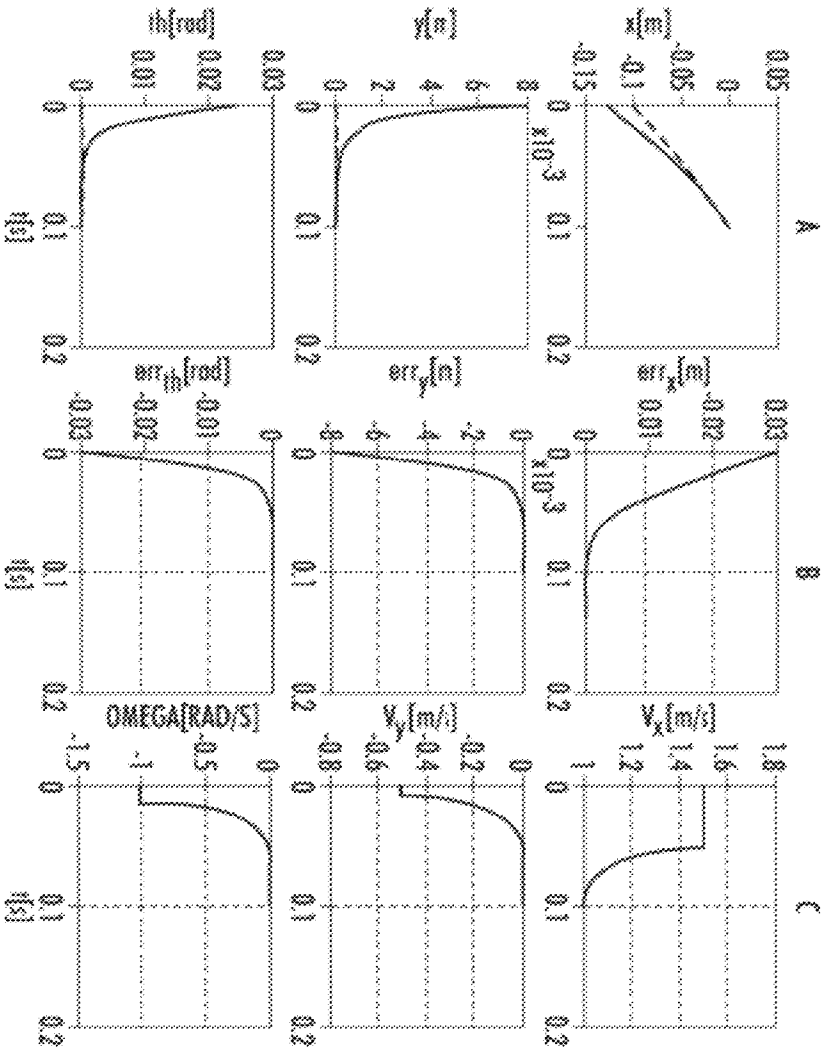
FIG. 6 is graphical data relating to the registration of the sheet; showing the sheet positions, sheet tracking errors and sheet velocities versus time.

The main sheet states during registration are shown in FIG. 6. The graphs in column A show the sheet position x, y and θ. The graphs in column B show the sheet position errors $e_x=x_d-x$, $e_y=y_d-y$ and $e_{74}=\theta_d-\theta$. The graphs in column C show the sheet velocities, $v_x$, $v_y$ and ω. In column A, reference is shown in dashed lines. As the sheet is moved through the registration device, the deviation from reference moves toward zero for each degree of freedom x, y and θ. Under the present example, the registration device was able to adjust the sheet to return it to the reference trajectory.

It will be appreciated that various of the above-disclosed and other features and functions or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

The invention claimed is:

1. A method for registering a sheet within a printing machine having a registration device having sheet contact points comprising:

determining a desired sheet reference trajectory;

sensing an actual sheet position using at least one sheet sensor;

comparing the sheet position to the desired sheet reference trajectory;

responsive to the comparison, calculating a desired sheet reference point velocity necessary to alter the sheet position to track the reference trajectory, the calculation being independent of the specific velocity and duration of operation of registration device sheet driving actuators needed to achieve the desired sheet reference trajectory;

responsive to the calculated desired sheet reference point velocity, calculating desired contact point velocities;

converting the desired contact point velocities to registration device specific actuator positions and velocities; and controlling registration device actuators with a registration device controller to achieve the desired contact point velocities.

2. The method of claim 1, wherein the conversion of the desired contact point velocities to the registration device specific actuator velocities is performed by utilizing inverse kinematics.

3. The method of claim 1, wherein sensing a sheet position includes receiving signals from a plurality of sheet sensors and calculating an estimated sheet position.

4. The method of claim 1, wherein calculating desired contact point velocities includes calculating two contact point velocities.

5. The method of claim 1, wherein controlling registration device actuators includes controlling the angular velocity, linear velocity, or a position of the actuators.

6. The method of claim 1, further comprising observing sheet position as the sheet moves through the sheet contact points and recalculating desired contact point velocities required to alter sheet position to track reference trajectory.

7. The method of claim 1, wherein the desired sheet reference point is the center of mass of the sheet.

8. The method of claim 1, wherein the desired sheet trajectory includes a process direction position, a cross-process direction position and an angular position.

9. The method of claim 1, wherein the desired sheet reference trajectory is determined by a sheet reference trajectory generator based on a position of a sheet entering the registration device.

10. A control system for a sheet registration device comprising:

a general unit including a processing device for determining desired contact point velocities for moving a sheet along a reference trajectory, wherein the contact point velocity determination is independent of the specific velocity and duration of operation of registration device sheet driving actuators needed to achieve the desired sheet reference trajectory; and a specific unit including a processing device operably connected to the general unit, the specific unit determining registration device-specific operating parameters for controlling registration device actuators to move the sheet along the reference trajectory.

11. The control system as defined in claim 10, wherein the general unit includes a sheet reference trajectory generator for determining a reference trajectory of the sheet.

12. The control system as defined in claim 11, wherein the general unit includes a sheet module operably connected to the sheet reference device, the sheet module determining desired sheet velocities to return a sheet to the reference trajectory.

13. The control system as defined in claim 12, wherein the general unit includes a general registration module operably connected to the sheet module, the general registration module determining desired contact point velocities responsive to the desired sheet velocities.

14. The control system as defined in claim 13, wherein the specific unit includes an inverse kinematic module operably connected to the general registration module, the inverse kinematic module converting the desired contact point velocities into actuator velocities for registration device actuators.

15. The control system as defined in claim 14, wherein the specific unit includes a registration device controller operably connected to the inverse kinematic module and registration device actuators, the registration device controller generating signals responsive to the inverse kinematic module to control operation of the registration device actuators to ensure that the actual contact point velocities substantially track the desired contact point velocities.

16. A system for registering a sheet prior to processing including:

a registration device engaging the sheet at a plurality of sheet contact points and a plurality of actuators for controlling the trajectory of a sheet;

at least one sheet sensor for identifying information related to an actual sheet position;

a general unit for calculating sheet adjustments independent of the operating parameters of the sheet driving actuators of the registration device, the general unit including a sheet reference trajectory generator for determining a reference sheet trajectory, a sheet module operably connected to the sheet reference trajectory generator, the sheet module comparing actual sheet position to the reference trajectory and determining a desired sheet reference point velocity for adjusting the sheet trajectory to track the reference trajectory, and a general registration module being in operative communication with the sheet module, the general registration module determining desired contact point velocities responsive to the desired sheet reference point velocity, the desired contact point velocities being determined independent of the specific velocity and duration of operation of registration device sheet driving actuators needed to achieve the desired sheet reference trajectory registration device; and a specific registration unit for determining registration device-specific operating parameters for controlling the registration device sheet driving actuators to move the sheet along the reference trajectory, wherein the specific registration unit is specific to the registration device.

17. The system of claim 16, wherein the specific registration unit further including an inverse kinematics module for determining operating parameters of the plurality of registration device actuators responsive to the desired contact point velocities.

18. The system of claim 17, further including a registration device controller in operative communication with the inverse kinematics module for controlling the plurality of registration device actuators responsive to the determined operating parameters.

19. The system of claim 18, wherein the determinations of the sheet reference trajectory generator, the sheet module, and the general registration module are independent of the registration device.

20. The system of claim 18, wherein operations of the inverse kinematics module and the registration device controller are specific to the registration device.

* * * * *